US008246149B2

(12) United States Patent
Takemura et al.

(10) Patent No.: US 8,246,149 B2
(45) Date of Patent: Aug. 21, 2012

(54) LIQUID EJECTING HEAD AND LIQUID EJECTING APPARATUS

(75) Inventors: Yoshihiro Takemura, Matsumoto (JP); Manabu Nagawatari, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 391 days.

(21) Appl. No.: 12/689,916

(22) Filed: Jan. 19, 2010

(65) Prior Publication Data

US 2010/0177146 A1 Jul. 15, 2010

Related U.S. Application Data

(63) Continuation-in-part of application No. 11/733,547, filed on Apr. 10, 2007, now Pat. No. 7,658,476.

(30) Foreign Application Priority Data

Apr. 10, 2006 (JP) ..... 2006-108056

(51) Int. Cl.
*B41J 2/045* (2006.01)

(52) U.S. Cl. ..... 347/72

(58) Field of Classification Search ..... 347/71–72
See application file for complete search history.

(56) References Cited

U.S. PATENT DOCUMENTS

| | | | |
|---|---|---|---|
| 6,048,053 | A | 4/2000 | Kamoi et al. |
| 6,398,350 | B2 | 6/2002 | Kitahara |
| 7,175,262 | B2 | 2/2007 | Furuhata |

FOREIGN PATENT DOCUMENTS

| | | |
|---|---|---|
| JP | 10-086366 | 4/1998 |
| JP | 2003-291337 | 10/2003 |
| JP | 2005-053144 | 3/2005 |

*Primary Examiner* — Jerry Rahll
(74) *Attorney, Agent, or Firm* — Workman Nydegger

(57) ABSTRACT

A liquid ejecting head including a pressure generating chamber which is in communicating with a nozzle orifice, a piezoelectric element having an active portion which is supplied a drive signal and an inactive portion which is not supplied the drive signal, and a film wiring substrate including an active wiring layer which is electrically connected to an individual connecting terminal of the active portion and an inactive wiring layer which is electrically connected to an individual connecting terminal of the inactive portion.

7 Claims, 7 Drawing Sheets

LIQUID EJECTING HEAD AND LIQUID EJECTING APPARATUS

CROSS-REFERENCE TO A RELATED APPLICATION

This application is a continuation-in-part of U.S. patent application Ser. No. 11/733,547 filed Apr. 10, 2007 which claimed priority to Japanese Patent Application Number 2006-108056 filed Apr. 10, 2006. The entire disclosures of these applications are expressly incorporated herein by reference.

BACKGROUND

1. Technical Field

The present invention relates to a liquid ejecting head and liquid ejecting apparatus that eject liquid. More particularly, it relates to an ink jet recording head and ink jet recording apparatus that discharge ink as a liquid.

2. Related Art

An ink jet recording head is structured such that a vibration plate forms part of pressure generating chambers that are in communication with associated nozzle orifices, and the vibration plate is deformed by piezoelectric elements to apply pressure to ink contained in the pressure generating chambers, so that ink droplets are discharged from the nozzle orifices. Then, an ink jet recording head that utilizes flexural deformation of piezoelectric elements, each having a lower electrode, a piezoelectric layer and an upper electrode, is in practical use.

Some of the ink jet recording heads are formed of drive vibrators (piezoelectric elements), which are supplied with a drive signal to deform, and dummy vibrators that are not supplied with a drive signal, and then a film wiring substrate is electrically connected to each electrode of the drive vibrator, which is, for example, described in JP-A-2003-291337. By heating solder provided on the wiring layers, the upper electrodes of the piezoelectric elements are electrically connected to the associated wiring layers of the wiring substrate.

When the upper electrodes of the piezoelectric elements are connected to the associated wiring layers of the wiring substrate through solder, flux that prevents generation of oxide by lowering the melting point of solder is generally used. However, because the flux is applied on the side of the wiring substrate on which solder is provided, redundant flux flows out to the side of the piezoelectric elements when the upper electrodes and the wiring layers are connected. This causes problems in which leakage current and/or migration occur between the adjacent piezoelectric elements, resulting in a decrease in relative displacement characteristics and deterioration of moisture resistance of the piezoelectric elements. Specifically, when a decrease in relative displacement occurs in the piezoelectric elements located at the opposite ends in a direction in which the piezoelectric elements are arranged in parallel with each other, stable ink discharge characteristics cannot be attained.

Note that these problems not only exist in ink jet recording heads that discharge ink but also exist in liquid ejecting heads that eject liquid other than ink.

SUMMARY

An advantage of some aspects of the invention is that a liquid ejecting head and liquid ejecting apparatus that prevent deterioration of moisture resistance of piezoelectric elements while preventing a decrease in relative displacement of the piezoelectric elements to attain stable liquid ejection characteristics are provided.

A first aspect of the invention is a liquid ejecting head including a pressure generating chamber which is in communicating with a nozzle orifice, a piezoelectric element having an active portion which is supplied a drive signal and an inactive portion which is not supplied the drive signal; and a film wiring substrate including an active wiring layer which is electrically connected to an individual connecting terminal of the active portion and an inactive wiring layer which is electrically connected to an individual connecting terminal of the inactive portion.

The piezoelectric elements include active portions and inactive portions. The inactive portions are not supplied with a drive signal and are not actually driven. The wiring layers of the wiring substrate include active wiring layers and inactive wiring layers. Each of the active wiring layers is electrically connected to the associated active portion of the piezoelectric elements. Each of the inactive wiring layers is electrically connected to the associated inactive portion of the piezoelectric element.

According to the first aspect of the invention, by providing the inactive wiring layers, flux, which is used for connections between the wiring layer and the piezoelectric elements, may be prevented from flowing out to the side of the active portions. This may prevent leakage current and/or migration from occurring between the adjacent piezoelectric elements due to flux, and may also prevent deterioration of moisture resistance of the piezoelectric elements due to flux. Specifically, the leakage current and migration of the active portions located at the opposite ends of the row of the parallel arranged active portions are prevented, so that a decrease in relative displacement of the active portions may be prevented. Thus, stable liquid ejecting characteristics over the plurality of active portions may be attained.

A second aspect of the invention provides a liquid ejecting apparatus having the liquid ejecting head of the first aspect of the invention. According to the second aspect, the liquid ejecting apparatus having improved moisture resistance and stable liquid ejection characteristics may be implemented.

DESCRIPTION OF EXEMPLARY EMBODIMENTS

A first exemplary embodiment according to the invention will be described below.

Figure 1:
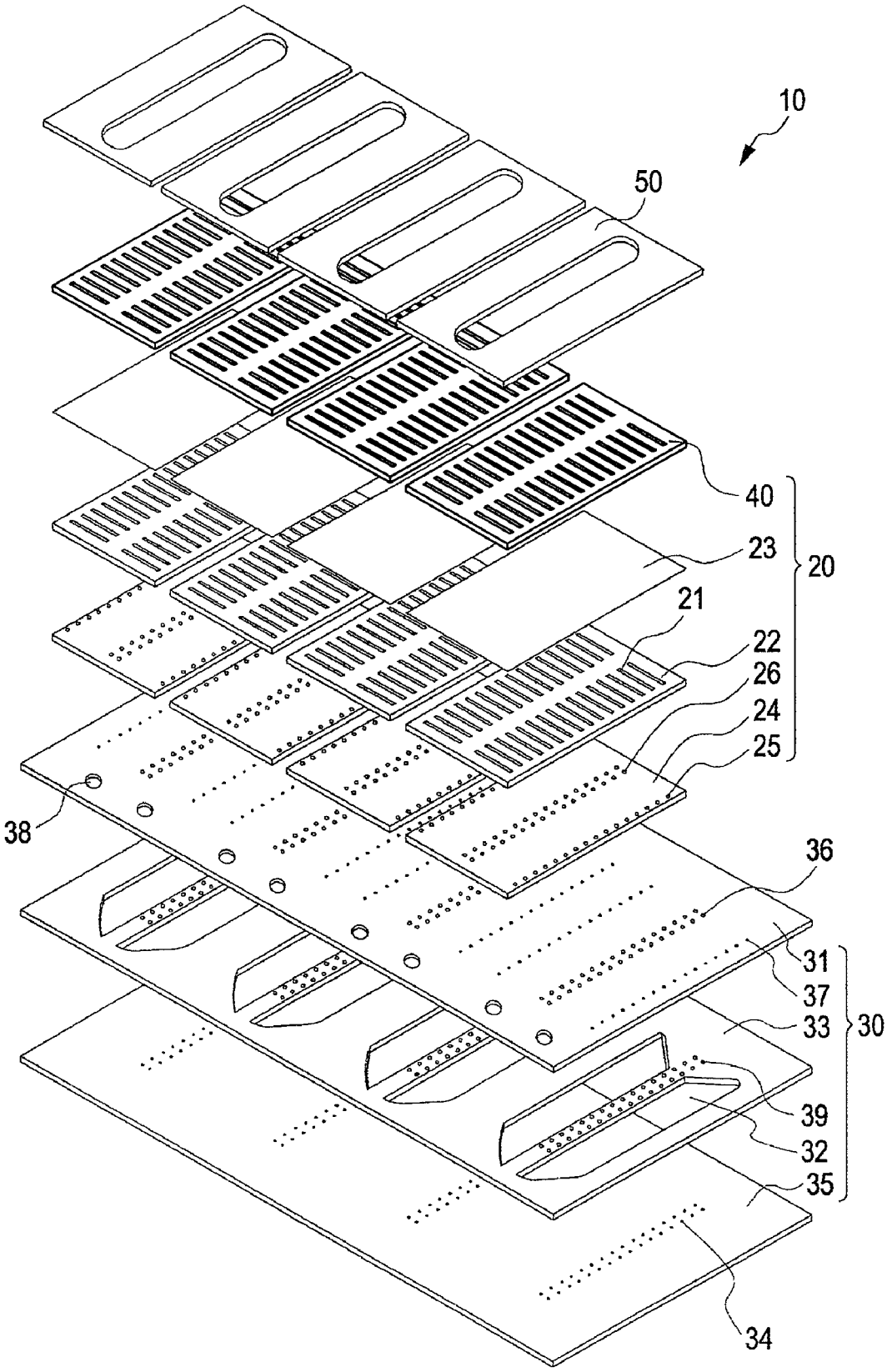
FIG. 1 is an exploded perspective view of an ink jet recording head according to a first exemplary embodiment of the invention.
Figure 2:
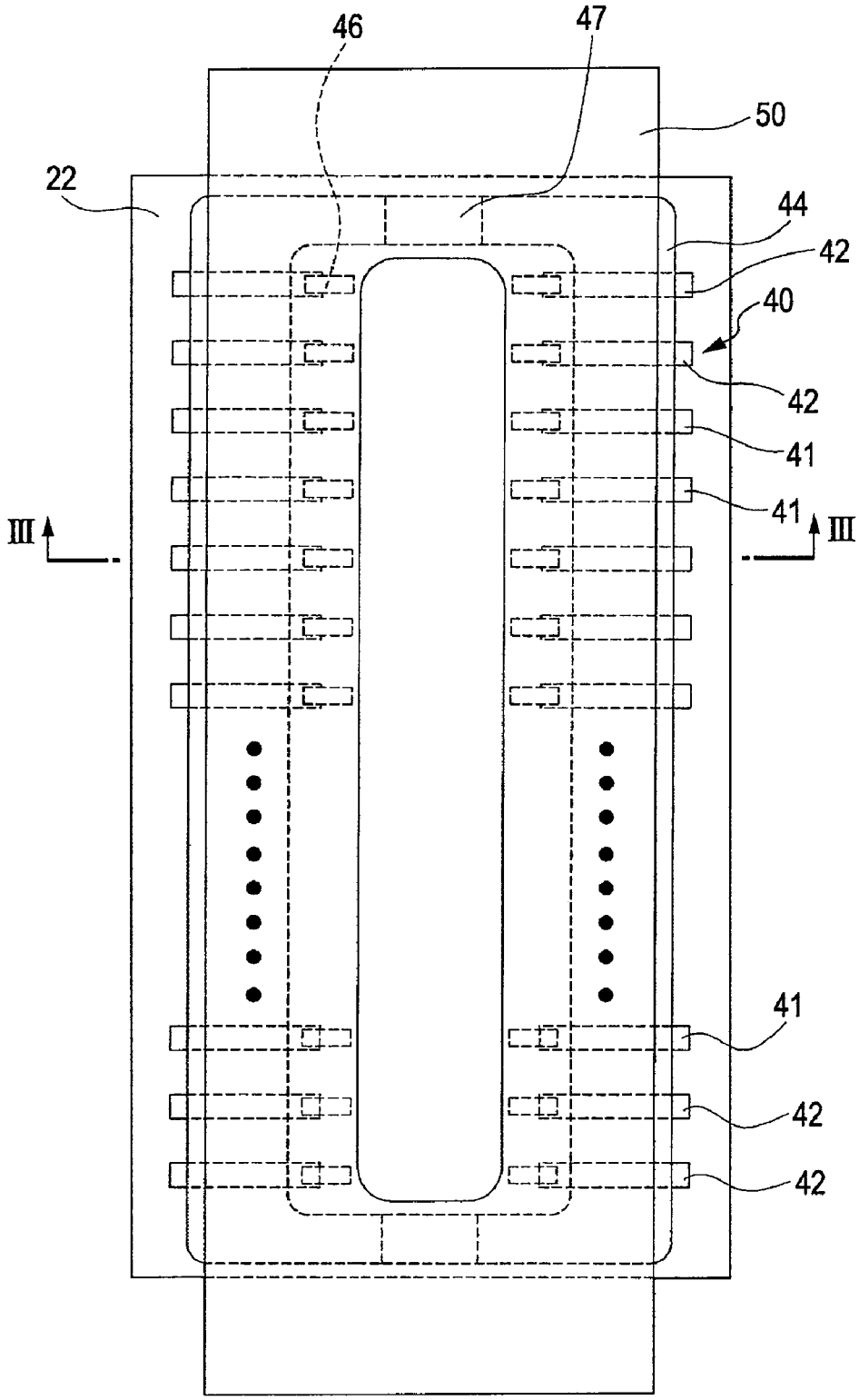
FIG. 2 is a plan view of the ink jet recording head according to the first exemplary embodiment of the invention.
Figure 3:
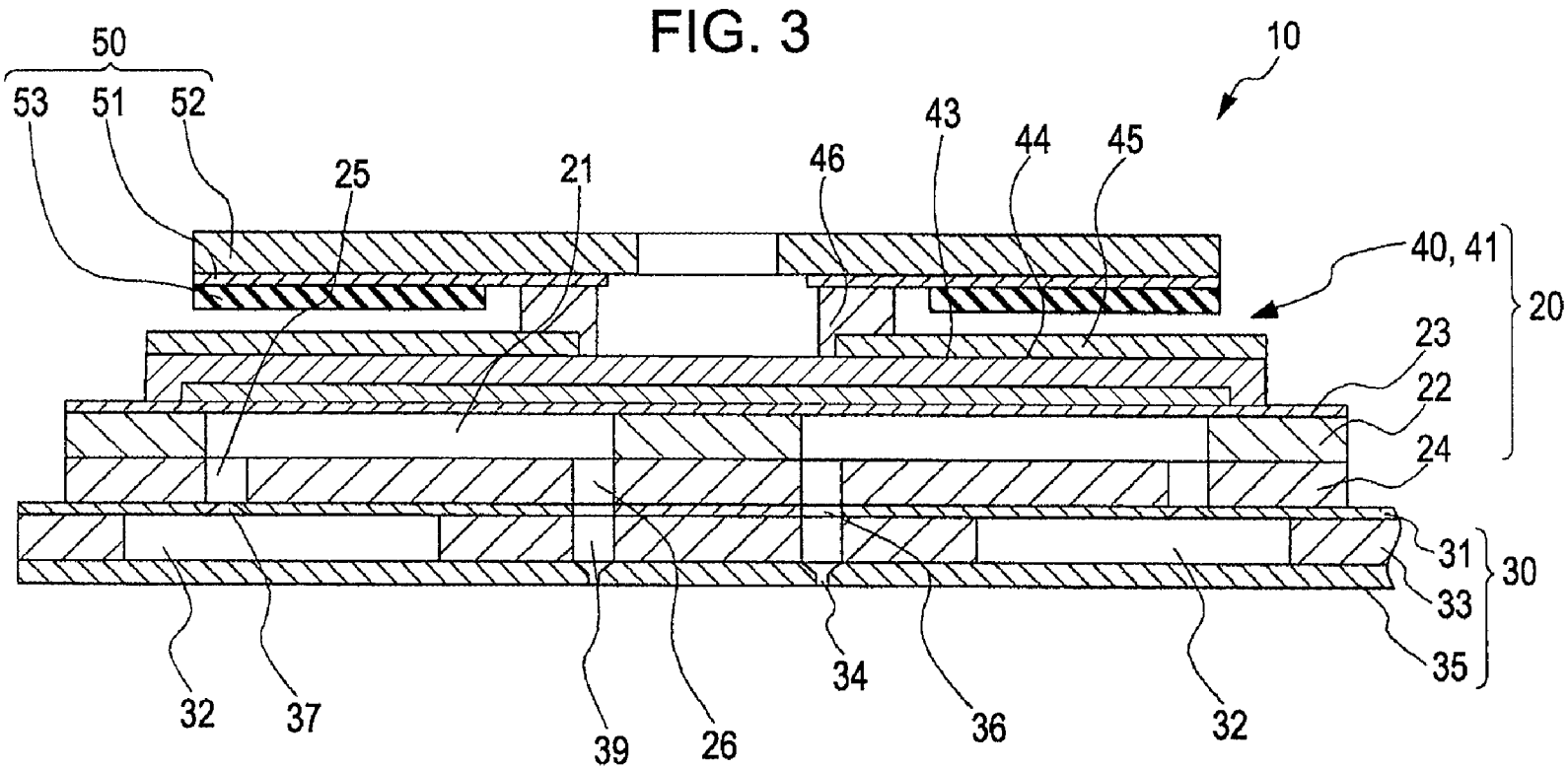
FIG. 3 is a cross-sectional view of the ink jet recording head, taken along the line III-III in FIG. 2.

FIG. 1 is an exploded perspective view of an ink jet recording head according to the first exemplary embodiment of the invention. FIG. 2 is a plan view of the ink jet recording head. FIG. 3 is a cross-sectional view that is taken along the line III-III in FIG. 2.

As shown in the drawings, an ink jet recording head 10 according to this exemplary embodiment includes a plurality of actuator units 20 (four in this exemplary embodiment, for example), a flow passage unit 30 on which these four actuator units 20 are fixed, and film wiring substrates 50 that are electrically connected to the associated actuator units 20.

Each actuator unit 20 is an actuator device having piezoelectric elements 40, and includes a flow passage forming substrate 22 in which pressure generating chambers 21 are formed, a vibration plate 23 that is provided on one side of the flow passage forming substrate 22, and a pressure generating chamber bottom plate 24 that is provided on the other side of the flow passage forming substrate 22.

The flow passage forming substrate 22 is formed of plate ceramic, such as alumina ($Al_2O_3$) and zirconia ($ZrO_2$), having a thickness of approximately 150 μm. In this exemplary embodiment, two rows of the plurality of pressure generating chambers 21 are formed so as to be arranged in parallel with each other in the widthwise direction. Then, the vibration plate 23 formed of a thin plate zirconia having a thickness of 10 μm is, for example, fixed to one side of the flow passage forming substrate 22. The pressure generating chambers 21 are sealed at one side by the vibration plate 23.

Each pressure generating chamber bottom plate 24 is fixed to the other side of the flow passage forming substrate 22 to seal the other side of the pressure generating chambers 21, and includes supply communication holes 25 and nozzle communication holes 26. The supply communication holes 25 are provided adjacent to one longitudinal ends of the associated pressure generating chambers 21 to establish fluid communication between the pressure generating chambers 21 and reservoirs, which will be described later. The nozzle communication holes 26 are provided adjacent to the other longitudinal ends of the associated pressure generating chambers 21 and are in communication with nozzle orifices 34, which will be described later.

The piezoelectric elements 40 are provided on each vibration plate 23 in areas opposite to the associated pressure generating chambers 21. For example, in this exemplary embodiment, two rows of the pressure generating chambers 21 are provided for each flow passage forming substrate 22, so that a piezoelectric element 40 with a two-rows of active and inactive portions are provided on each vibration plate 23, such that the inactive portions 42 that do not actually cause ink to discharge are provided at each end of each row of the piezoelectric element 40. In other words, as shown in FIG. 2, a plurality of active portions 41 that cause ink to discharge are provided on the vibration plate 23 in a row, and the at least one (two in this exemplary embodiment) inactive portions 42 that do not actually cause ink to discharge are provided outside each end of the row of the active portions 41.

Each piezoelectric element 40 includes a lower electrode film 43 that is provided on the vibration plate 23, a piezoelectric layer 44 that is provided over the lower electrode film 43, and an upper electrode film 45 that is provided on the piezoelectric layer 44 for each pressure generating chamber. The piezoelectric layer 44 is formed by adhering a green sheet made of piezoelectric material or by printing piezoelectric material. The lower electrode film 43 is provided so as to extend below the piezoelectric layer 44, thus becoming a common electrode for the piezoelectric elements 40. The lower electrode film 43 functions as a part of the vibration plate. Needless to say, the lower electrode film 43 may also be provided separately for each piezoelectric layer 44.

Note that the flow passage forming substrate 22, the vibration plate 23 and the pressure generating chamber bottom plate 24, which are the layers of each actuator unit 20, are formed so that clayey ceramic materials, so-called green sheets, are formed to have a predetermined thickness, and, for example, after perforating the pressure generating chambers 21, or the like, the green sheets are laminated and then fired. Thus, the green sheets are integrated without any adhesives. Thereafter, the piezoelectric element 40 is formed on the vibration plate 23.

Meanwhile, the flow passage forming unit 30 includes an ink supply port forming substrate 31 that is bonded to the pressure generating chamber bottom plate 24 of the actuator unit 20, a reservoir forming substrate 33 in which the reservoirs 32, each of which is a common ink chamber for the plurality of pressure generating chambers 21, are formed, and a nozzle plate 35 in which the nozzle orifices 34 are formed.

The ink supply port forming substrate 31 is formed of thin plate zirconia having a thickness of 150 μm, and includes nozzle communication holes 36 that connect the nozzle orifices 34 with the pressure generating chambers 21, ink supply ports 37 that connect the reservoirs 32 with the pressure generating chambers 21 together with the supply communication holes 25, and ink introducing ports 38 that are in communication with the reservoirs 32 and supply ink that is sent from an external ink tank.

The reservoir forming substrate 33 is formed of a plate material suitable for forming an ink flow passage, which is made of, for example, stainless steel 150 μm thick having anti-corrosive property. The plate material, which is the reservoir forming substrate 33, includes the reservoirs 32 that supply the pressure generating chambers 21 with ink supplied from the external ink tank (not shown) and the nozzle communication holes 39 that establish fluid communication between the pressure generating chambers 21 and the nozzle orifices 34.

The nozzle plate 35 is formed of, for example, thin plate stainless steel with the nozzle orifices 34 perforated therethrough at the same pitch as that the pressure generating chambers 21 are arranged. For example, in this exemplary embodiment, the flow passage forming substrate 22 is provided with two rows of the pressure generating chambers 21, so that the nozzle plate 35 is also provided with two rows of the nozzle orifices 34. In addition, the nozzle plate 35 is bonded to the reservoir forming substrate 33 on the opposite face relative to the flow passage forming substrate 22 so as to seal one side of the reservoirs 32.

The flow passage unit 30 is formed by fixing these ink supply port forming substrate 31, reservoir forming substrate 33 and nozzle plate 35 with an adhesive, thermowelding film, or the like. In this exemplary embodiment, the reservoir forming substrate 33 and the nozzle plate 35 are formed of stainless steel. However, they may be formed of ceramics and then formed integrally with the flow passage unit 30, as in the case of the actuator units 20.

The flow passage unit 30 and the actuator units 20 are fixed to each other by bonding with an adhesive or thermowelding film.

As shown in FIGS. 2 and 3, individual connecting terminals 46 made of gold (Au), or the like, that are electrically connected to the upper electrode films 45, are each provided at one longitudinal end of each of the active portions 41 and inactive portions 42 of the piezoelectric element 40 in the area opposite to the peripheral wall of each pressure generating chamber 21. The individual connecting terminal 46 is provided for both the active portions 41 and the inactive portions 42 of the piezoelectric element 40. In addition, as shown in FIG. 2, a common connecting terminal 47 made of gold (Au), that is electrically connected to the lower electrode film 43, is provided on each outside of the rows of the piezoelectric element 40 between the two rows of the parallel arranged active and inactive portions 41 and 42. Then, wiring layers 51 are provided on the film wiring substrate 50 and electrically connected to the individual connecting terminals 46 and the common connecting terminals 47 that are respectively provided on the upper electrode films 45 and lower electrode film 43 of the piezoelectric element 40. A drive signal is supplied from a driving circuit (not shown) to the piezoelectric elements 40 through the wiring substrate 50.

The wiring substrate 50 is formed as one extending over the two rows of the piezoelectric element 40, and is formed of, for example, a flexible printed circuit (FPC), a tape carrier package (TCP), or the like. Specifically, the wiring substrate 50 is formed such that the wiring layers 51 having a predetermined pattern is formed on the surface of a base film 52 made of polyimide, or the like, using a copper foil, and an area of the wiring layer 51 other than terminal portions that are electrically connected to the piezoelectric element 40 are covered with an insulating material 53 such as a resist.

Figure 4A:
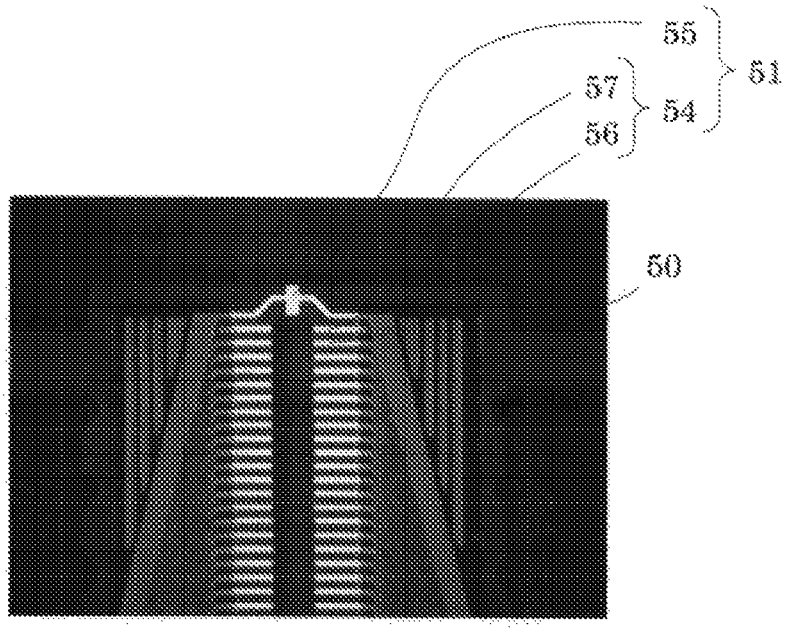
FIGS. 4A and 4B are photographs each illustrating a wiring substrate according to the first exemplary embodiment of the invention.
Figure 4B:
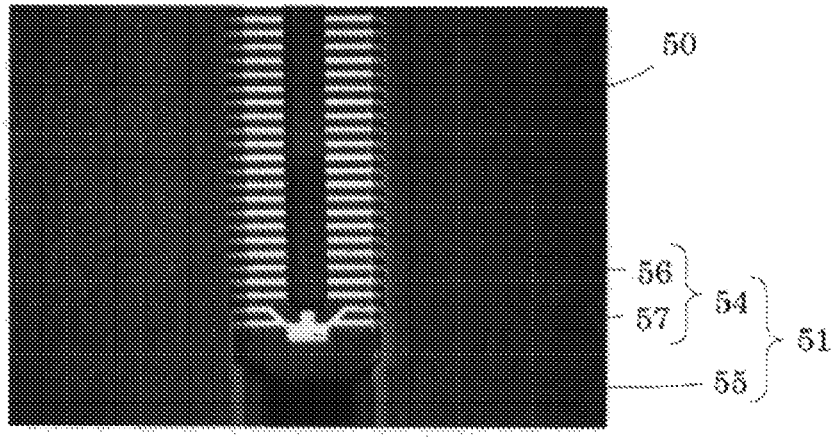
Figure 5A:
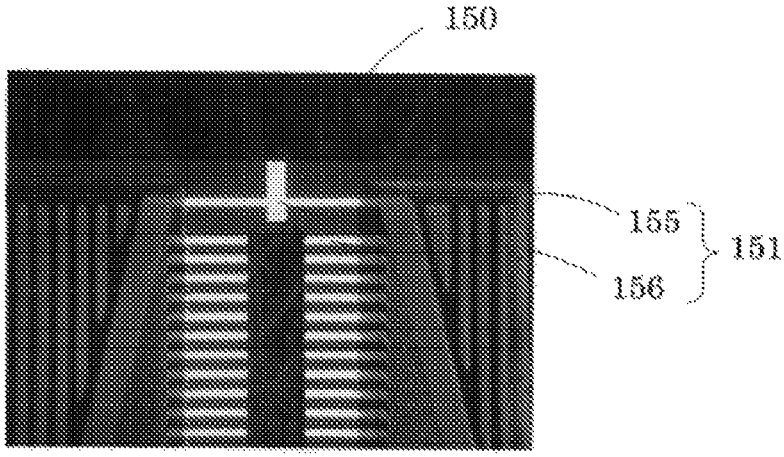
FIGS. 5A and 5B are photographs each illustrating a wiring substrate according to the known art.
Figure 5B:
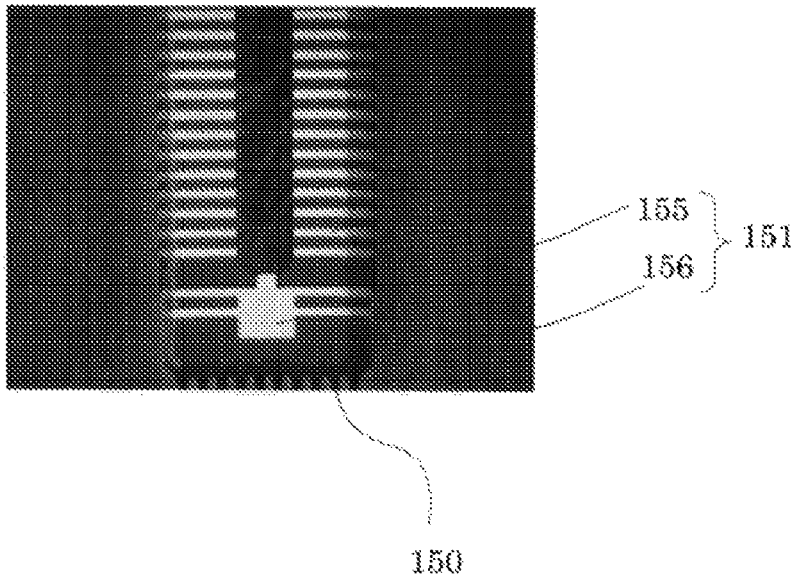
Figure 6A:
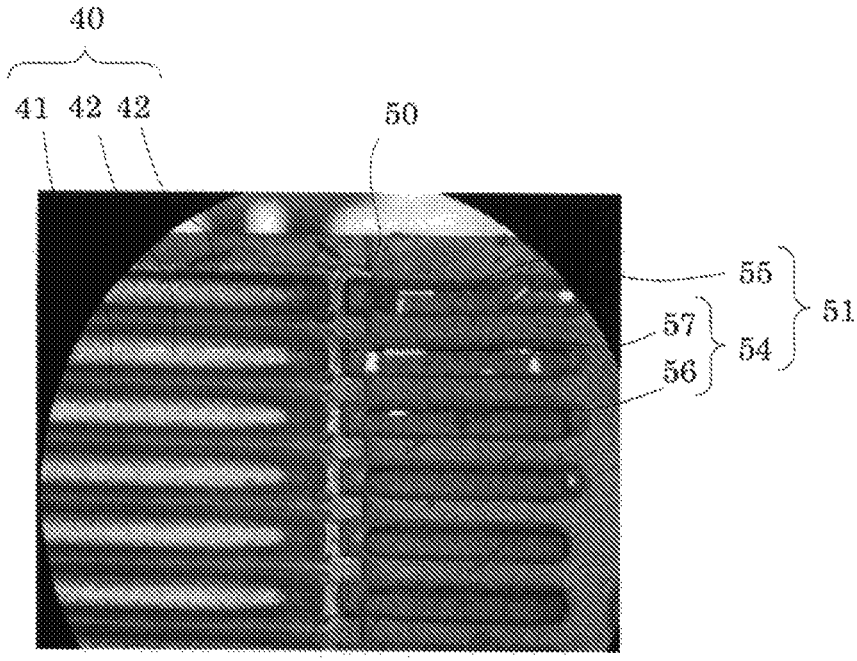
FIG. 6A is a photograph illustrating a bonding state of the wiring substrate according to the first exemplary embodiment of the invention.
Figure 6B:
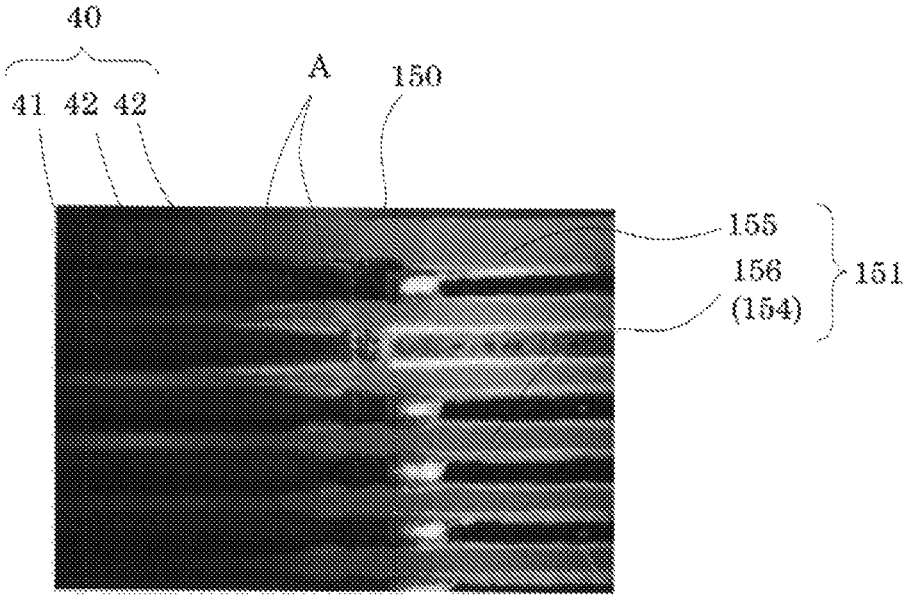
FIG. 6B is a photograph illustrating a bonding state of the wiring substrate according to the known art.

The wiring layers 51 of the wiring substrate 50 will be specifically described. FIGS. 4A and 4B are photographs each illustrating the wiring substrate according to the first exemplary embodiment. FIGS. 4A and 4B are photographs each showing the end of the parallel arranged piezoelectric element. FIGS. 5A and 5B are photographs each illustrating a wiring substrate according to the known art. FIG. 6A is an enlarged photograph that illustrates a substantial part of the wiring substrate after bonding according to the first exemplary embodiment. FIG. 6B is an enlarged photograph that illustrates a substantial part of the wiring substrate after bonding according to the known art.

As shown in FIGS. 4A and 4B, the wiring layers 51 of the wiring substrate 50 includes pectinate individual wiring layers 54 that are electrically connected to the individual connecting terminals 46 of the active portions 41, and a common wiring layer 55 that is electrically connected to the common connecting terminal 47 and provided to extend around the individual wiring layers 54.

The individual wiring layers 54 include active wiring layers 56 and inactive wiring layers 57. Each active wiring layer 56 is provided in the area opposite to the individual connecting terminal 46 of the active portions 41 and are electrically connected to the individual connecting terminal 46 of the active portions 41 of the piezoelectric element 40. Each inactive wiring layer 57 is provided in the area opposite to the individual connecting terminal 46 of the inactive portions 42 of the piezoelectric element 40 located adjacent to the active portions 41 between the two inactive portions 42 and is electrically connected to the individual connecting terminal 46 of that inactive portions 42.

The active wiring layers 56 electrically connect a driving circuit, such as a semiconductor integrated circuit, with the active portions 41 so as to supply a drive signal from the driving circuit to the active portions 41. On the other hand, the inactive wiring layers 57 are not electrically connected to the driving circuit. The inactive wiring layers 57 are provided independently of the active wiring layers 56 and the common wiring layers 55 in a discontinuous manner. The inactive wiring layers 57 interrupt the supply of a drive signal from the driving circuit to the inactive portions 42.

The common wiring layer 55 is provided so as to be electrically connected to the common connecting terminals 47 that are provided on the lower electrode film 43, which is a common electrode for the piezoelectric element 40. Each common wiring layer 55 is provided in the area opposite to the individual connecting terminal 46 of the outer inactive piezoelectric element 42 between the two inactive portions 42 and is electrically connected to the individual connecting terminal 46 of the outer portion 42.

The wiring layers 51 include the individual wiring layers 54 of the wiring substrate 50 and the common wiring layers 55. The individual wiring layers 54 include the active wiring layers 56 and the inactive wiring layers 57. The wiring layers 51 and the individual connecting terminals 46 and common connecting terminals 47 of the actuator unit 20 are electrically connected through solder, as shown in FIG. 3.

The wiring layers 51 of the wiring substrate 50 are electrically connected to the individual connecting terminals 46 and common connecting terminals 47 of the actuator unit 20 in such a manner that a solder layer (not shown) made of solder is formed on each of the wiring layers 51 of the wiring substrate 50, flux is applied on the solder layer so as to prevent generation of oxide by lowering the melting point of solder, and, after that, the solder layer is heated in a state where the wiring substrate 50 is brought into contact with the connecting terminals 46, 47 with a predetermined pressure.

Then, the inactive wiring layers 57, that are electrically connected to the inactive portions 42, and the common wiring layers 55 are provided on the wiring layers 51 of the wiring substrate 50. This prevents redundant flux from flowing out to the side of the active portions 41 when the solder is heated, as shown in FIG. 6A. Thus, leakage current and/or migration are prevented from occurring between the adjacent active portions 41, thus preventing a decrease in relative displacement of the active portions 41 and deterioration of moisture resistance. In particular, by preventing a decrease in relative displacement of the active portions 41 on the opposite sides of the parallel arranged active portions 41, stable ink discharge characteristics may be attained among the plurality of active portions 41.

That is, when the wiring layer is not provided with the inactive wiring layers, which are electrically connected to the inactive portions, and the common wiring layers, as in the case of the known wiring substrate, specifically, when a known wiring substrate 150 is provided with wiring layers 151 that includes active wiring layers 156 (individual wiring layers 154) that are electrically connected to the individual connecting terminals 46 of the active portions 41 and common wiring layers 155 that are electrically connected to the common connecting terminals 47 as shown in FIGS. 5A and 5B, flux A that is applied on the areas opposite to the inactive portions 42, when heated, flows out to the side of the active portions 41 located adjacent to the inactive portions 42. The flux A that has flowed out to the active portions 41 causes leakage current and/or migration between the adjacent active portions 41. This causes a decrease in relative displacement of the active portions 41 and deterioration of moisture resistance of the active portions 41. In particular, when relative displacement of the active portions 41 on the opposite sides of the parallel arranged active portions 41 is decreased, stable ink discharge characteristics may not be attained among the plurality of active portions 41.

As described above, in this exemplary embodiment, because the inactive wiring layers are provided in the areas opposite to the inactive portions, redundant flux is prevented from flowing out to the side of the active portions, thus preventing leakage current and migration from occurring among the adjacent active portions. This may prevent a decrease in relative displacement of the active portions and may also prevent deterioration of moisture resistance. In particular, by preventing a decrease in relative displacement of the active portions located on the opposite sides of the parallel arranged active portions, stable ink discharge characteristics may be attained among the plurality of active portions.

Though the first exemplary embodiment according to the invention is described above, the basic structure according to the invention is not limited to the above-described structure. In the above described first exemplary embodiment, of the two inactive portions 42, the inactive wiring layer 57 is provided in the area opposite to the individual connecting terminal 46 of the inner inactive portion 42 (which is adjacent to the active portion 41), and the common wiring layer 55 of the wiring substrate 50 is provided in the area opposite to the individual connecting terminal 46 of the outer inactive portions 42, but it is not specifically limited to this configuration. In an alternative exemplary embodiment, the inactive wiring layer 57 may be provided in an area opposite to the individual connecting terminals 46 of the two inactive portions 42. In this case, in order to make the common wiring layer 55 be discontinuous with the inactive wiring layer 57, the common wiring layer needs to be located on the outer peripheral side of the wiring substrate 50.

In the above first exemplary embodiment, though two inactive portions 42 are respectively provided on the opposite sides of each row of the active portions 41, the number of inactive portions 42 is not specifically limited to it.

Furthermore, in the above first exemplary embodiment, though the active and inactive portions 41 and 42 of the piezoelectric element 40 are extended to the areas opposite to the peripheral walls of the associated pressure generating chambers 21, and the individual connecting terminals 46 that are electrically connected to the upper electrode films 45 are provided at one longitudinal ends of the elongated active and inactive portions 41 and 42, it is not specifically limited to this configuration. For example, the active and inactive portions 41 and 42 may be provided in the areas opposite to the pressure generating chambers 21, and elongated wirings may be formed to extend from the upper electrode films of the piezoelectric element up until the areas opposite to the peripheral walls of the pressure generating chambers 21. In this case as well, as in the case of the first exemplary embodiment, by providing the inactive wiring layers 57, flux may be prevented from flowing out to the side of the piezoelectric element. This may prevent a decrease in relative displacement of the piezoelectric elements due to the flow of the flux to attain stable ink discharge characteristics, and may prevent deterioration of moisture resistance of the piezoelectric element.

Figure 7:
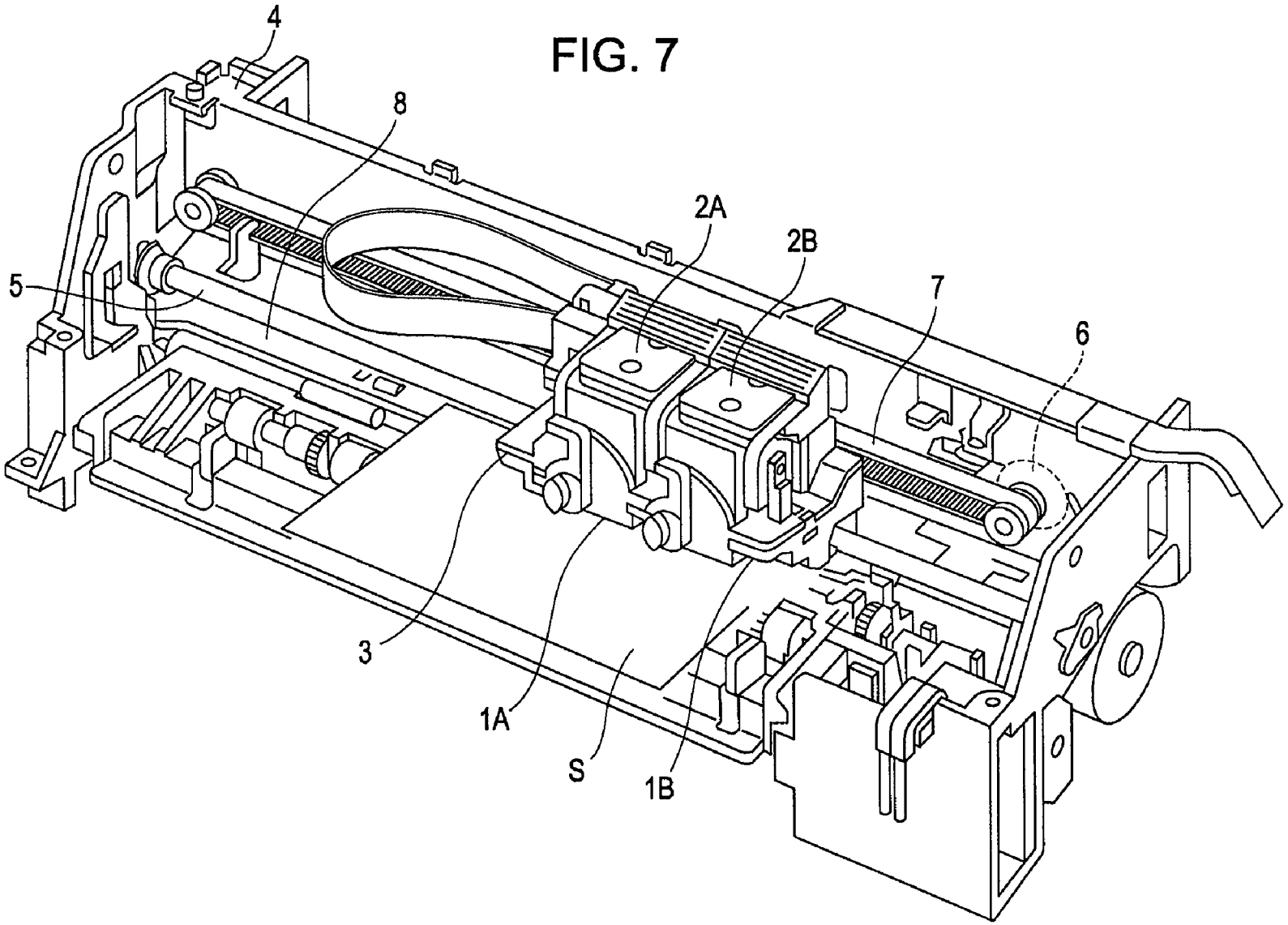
FIG. 7 is a schematic view of an ink jet recording apparatus according to an alternative exemplary embodiment of the invention.

The ink jet recording head according to the above exemplary embodiments constitutes part of a recording head unit having an ink flow passage that is in fluid communication with an ink cartridge, or the like, and is installed in an ink jet recording apparatus. FIG. 7 is a schematic view of an example of the ink jet recording apparatus.

As shown in FIG. 7, recording units 1A, 1B, each having an ink jet recording head, are detachably provided with respective cartridges 2A, 2B that constitute ink supply portions. A carriage on which these recording units 1A, 1B are mounted is provided so as to be slidable in the axial direction of a carriage shaft 5 fixed to an apparatus body 4. The recording head units 1A, 1B, for example, discharge black ink composition and color ink composition, respectively.

As the driving force of a drive motor is transmitted to the carriage 3 through a plurality of gears (not shown) and a timing belt 7, the carriage 3 that mounts the recording head units 1A, 1B thereon is moved along the carriage shaft 5. On the other hand, the apparatus body 4 is provided with a platen 8 along the carriage shaft 5. A recording sheet S, which is a recording medium such as a paper that is fed by a paper feed roller (not shown), is wound around the platen 8 to be transported.

Though in the above first exemplary embodiment, an ink jet recording head is described as an example of the liquid ejecting head, the present invention widely covers various types of liquid ejecting head. The invention may also be applied to a method of manufacturing a liquid ejecting head that ejects liquid other than ink. Other types of liquid ejecting head are, for example, various types of recording head used for an image recording apparatus, such as a printer, a color material ejecting head used for manufacturing a color filter, such as a liquid crystal display, an organic EL display, an electrode material ejecting head, such as FED (field emission display), used for electrode formation, and a bioorganic substance ejecting head used for manufacturing a biochip, or the like.

What is claimed is:

1. A liquid ejecting head comprising:

a pressure generating chamber which is in communicating with a nozzle orifice;

a piezoelectric element having an active portion which is supplied a drive signal and an inactive portion which is not supplied the drive signal; and a film wiring substrate including an active wiring layer which is electrically connected to an individual connecting terminal of the active portion and an inactive wiring layer which is electrically connected to an individual connecting terminal of the inactive portion.

2. The liquid ejecting head according to claim 1, wherein the piezoelectric element has a plurality of the active portions and a plurality of the inactive portions, and the inactive portions are provided on opposite sides of a row of the active portions which are arranged in parallel with each other.

3. The liquid ejecting head according to claim 1, wherein the piezoelectric element includes a common electrode, a piezoelectric layer, and an individual electrode.

4. The liquid ejecting head according to claim 3, wherein the film wiring substrate further includes a common wiring layer which is electrically connected to the common electrode.

5. The liquid ejecting head according to claim 4, wherein the inactive wiring layer is formed between the active wiring layer and the common wiring layer.

6. The liquid ejecting head according to claim 4, wherein the active wiring layer, the inactive wiring layer, and the common wiring layer are electrically disconnected each other.

7. A liquid ejecting apparatus including the liquid ejecting head according to claim 1.

* * * * *